United States Patent [19]

Bowes et al.

[11] Patent Number: 4,627,790

[45] Date of Patent: Dec. 9, 1986

[54] PORTABLE PUMP WITH AIR SEAL

[75] Inventors: H. David Bowes; Edward S. Kuhn, both of Erie, Pa.

[73] Assignee: Thompson-Chemtrex, Inc., Erie, Pa.

[21] Appl. No.: 672,371

[22] Filed: Nov. 16, 1984

[51] Int. Cl.[4] ..... F04D 29/10; F04D 3/02

[52] U.S. Cl. ..... 415/53 R; 415/111; 415/175

[58] Field of Search ..... 415/53 R, 73, 109, 214, 415/110, 111, 112, 170 B, 175

[56] References Cited

U.S. PATENT DOCUMENTS

| | | | |
|---|---|---|---|
| 1,027,947 | 5/1912 | Wedge | 415/109 X |
| 1,460,982 | 7/1923 | Records | 415/109 UX |
| 3,836,280 | 9/1974 | Koch | 415/175 |
| 4,073,606 | 2/1978 | Eller | 415/111 X |
| 4,239,422 | 12/1980 | Clancey | 415/112 X |
| 4,341,503 | 7/1982 | Gschwender et al. | 415/175 X |
| 4,406,582 | 9/1983 | LaGrange | 415/214 UX |

*Primary Examiner*—Robert E. Garrett
*Assistant Examiner*—Joseph M. Pitko
*Attorney, Agent, or Firm*—Webb, Burden, Robinson & Webb

[57] ABSTRACT

An axial flow liquid pump comprises an outer tube, a smaller diameter inner tube, and a driven shaft journaled near the top of the inner tube. An upwardly opening cup-shaped rotor is secured in the lower end of the shaft such that a cylindrical sidewall is at least partially spaced between the inner tube and the outer tube. A helical flange is secured to the outer surface of the cylindrical sidewall. Radial passages are provided in said rotor below the helical flange. The passages are arranged to be above the lower end of the inner tube. A baffle plate having passages therein is secured just above the rotor.

14 Claims, 5 Drawing Figures

PORTABLE PUMP WITH AIR SEAL

BACKGROUND

This invention is directed to a portable liquid pump having a novel air seal.

The pump according to this invention is especially useful for emptying drums, say 55 gallon drums, filled with chemical solutions, plating solutions, and the like.

A feature of the pump is positive downward air flow along the driven shaft making expensive and fragile seals for protecting the shaft bearing and motor unnecessary. The need for mechanical or lip seals about the drive shaft is eliminated because the air flow prevents corrosive liquid or vapor from reaching the bearing or motor.

The entire pump may be made of parts that are threaded together making occasional cleaning very simple.

The pump is versatile having the capability of pumping liquid densities up to 1.8 specific gravity and with the viscosities up to 200 cps (centipoise).

The pump tolerances are in many cases wide and even after wearing as a result of pumping liquids containing abrasive particles the pump efficiency diminishes very little.

Air sealed pumps are not new. U.S. Pat. No. 3,712,755 for example, illustrates the principle of providing an impeller for drawing air down along the drive shaft supporting the impeller for pumping liquid. This patent teaches introducing a water spray along the shaft to aid in protecting the bearing or motor from corrosive vapors. A better air seal, that is one having a truly positive pressure flow along the shaft, would eliminate the need for the water spray. U.S. Pat. No. 3,767,321 teaches an axial flow pump wherein an auxiliary impeller acts upon the liquid surrounding the drive shaft to balance the upward pressure created by the main impeller. This is not an air seal pump as air is not continuously drawn down the length of the shaft.

SUMMARY OF THE INVENTION

Briefly according to this invention, there is provided an axial flow liquid pump. The pump comprises an outer tube or pipe having an intake opening at one end, preferably a lower end, which may be submerged in liquid to be pumped and an outlet opening near the other end, preferably an upper end. A smaller diameter pendent inner tube or pipe is within and, preferably substantially coaxial with the outer tube. A drive shaft is journaled near one end of the inner and outer tubes or thereabove. The driven shaft is within the inner tube. A cup shaped rotor is secured to the free end of the driven shaft. The rotor has a generally cylindrical sidewall and an axial end face. The end face is provided with means for securing it to the free end of the driven shaft. The cylindrical sidewall extends partially into the annular space between the inner tube and the outer tube. The rotor has a screw or helical flange secured to the outer surface of its cylindrical sidewall. Radial passages are provided through the cylindrical sidewall, preferably, below the helical flange. The passages are preferably arranged to be above the lower end of the inner tube. There is a first clearance between the inner surface of the inner tube and the shaft to permit the flow of air. There is a second clearance between the outer surface of the inner tube and the inner surface of the cylindrical sidewall of the rotor such that air and liquid may be drawn through the first and second clearances respectively and expelled through the passages in the sidewall. Means must be provided to prevent recirculation of excessive amounts of air through the second clearance. Preferably, a baffle plate having passages therein is secured above the impeller such that air entrained in the fluid lifted by the helical flange is not recirculated down through the second clearance.

It is a preferred feature of the axial flow pump according to this invention that the baffle comprises an annular plate with a plurality of spaced passages therethrough in which the top openings of each passage are rotated around the axis of the driven shaft from the bottom opening of each passage. The rotation is in the normal direction of rotation of the driven shaft. Stated another way, the baffle may comprise an annular plate having a plurality of spaced passages each passage of which has an axis which is generally in a plane parallel to the axis of the driven shaft but at an angle to a line in the plane which is parallel to the axis of the driven shaft. The baffle may be secured to either the inner tube or to the outer tube; preferably the baffle is secured to the outer tube.

In the design of an axial flow pump according to this invention, it is necessary to reduce the clearance between the driven shaft and the inner tube to limit the amount of air drawn into the rotor. Excess air drawn into the rotor will cause pumping failure. Once this dimension has been established for a particular rotor configuration, it will not increase by wear due to the fact that there is only occasional touching between the shaft and the inner tube and the two elements are separated by air. The clearance between the inner surface of the sidewall of the rotor and the outer surface of the inner tube must be established for a particular rotor but is not particularly critical. It is desirable to establish the clearance to accommodate particles that may be carried in the liquids to be pumped but sufficiently small so that with considerable wear the pumping properties are not diminished.

DRAWINGS

Further features and other objects and advantages of this invention will become clear from the following detailed description of the invention made with reference to the drawings, in which FIG. 1 illustrates the overall configuration of a portable pump arranged to pump liquid out of a drum which is shown in section;

DESCRIPTION OF THE PREFERRED EMBODIMENTS

Figure 1:
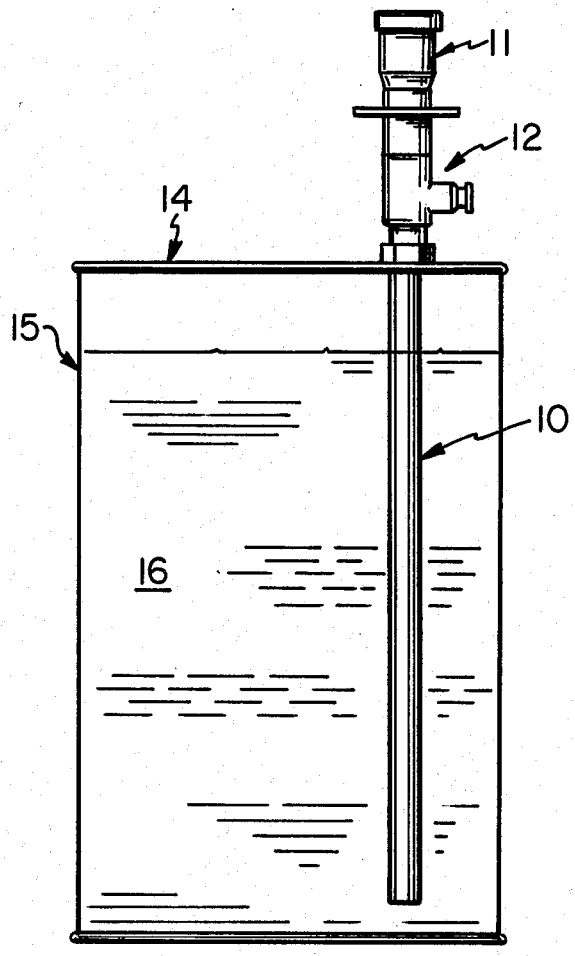

Referring now to FIG. 1, there is shown the typical arrangement of a portable pump according to this invention for emptying a drum 15 of corrosive liquid 16. This is but one of the many uses and configurations. The pump comprises a submersible portion 10 and a pump motor 11 connected by an intermediate or exhaust section 12. As illustrated, the pump is inserted through the cover 14 of the drum 15.

Figure 2:
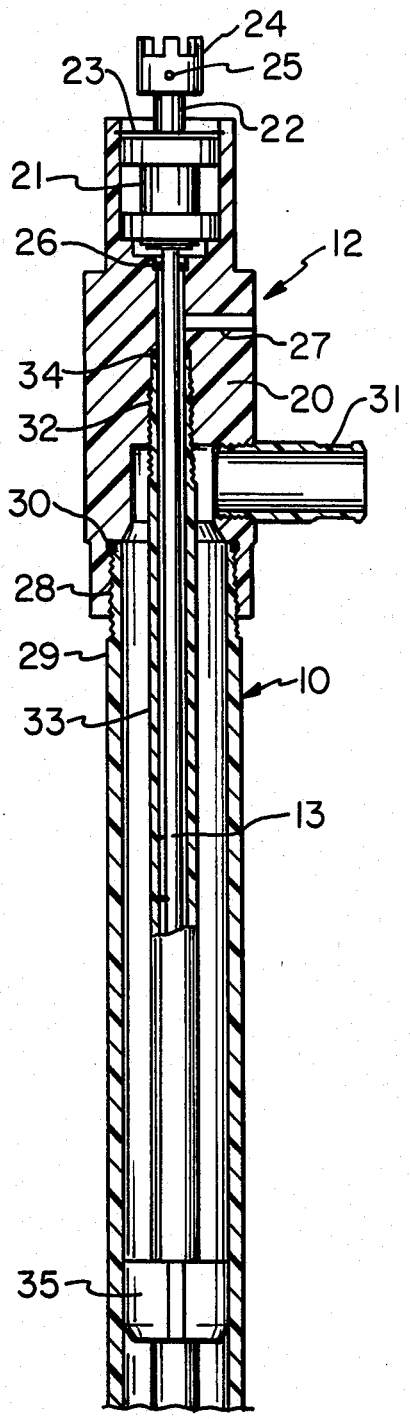
FIG. 2 illustrates in section the upper portion of a pump according to this invention exclusive of the motor.

Referring now to FIG. 2, there is shown the exhaust section 12 at the upper end of the submersible portion 10. The exhaust section comprises a headpiece 20 having an axial bore therein through which the driven shaft 13 passes. The headpiece supports the bearing assembly 21 for the overhung driven shaft 13. The bearing assembly 21 sits in a cylindrical recess at the top of the headpiece and is held in place by a snap ring 23. An extension of the shaft 22 above the bearing assembly has one half of a coupling assembly 24 held thereto by pin 25. This enables an electric or air motor to be mounted on top of the headpiece and to rotatably couple to the driven shaft.

Below the bearing assembly is a vapor seal 26 comprising an annular recess for receiving an O-ring which is sized to loosely contact the shaft when the shaft is rotating but to provide an adequate vapor seal when the shaft is at rest. This O-ring seal provides a measure of protection for the bearing when the pump is left partially submersed in a liquid that produces corrosive vapors which migrate up the space along the driven shaft. The other half of the coupling and the drive motor (not shown in FIG. 2) are secured over the upper end of the headpiece. A passage 27 connects the exterior of the headpiece and the axial bore below the vapor seal. This passage supplies air to the shaft as will be explained. The lower end of the headpiece has a large diameter recess within internal threads 28 for receiving an outer tube 29 and capturing gasket 30. A large transverse bore connects the exterior of the head with the large diameter recess in the lower end of the headpiece. The transverse bore is threaded to receive the exhaust spout 31. The axial bore through which the shaft passes has an enlarged portion opening into the large diameter recess. The enlarged portion is provided with internal threads 32 for receiving the threaded end of inner tube 33 and capturing gasket 34. The driven shaft 13 passes down through the inner tube 33. The inner tube is held relative to the outer tube and at spaced intervals by spacers 35 that only slightly impede the flow of liquid up between the inner and outer tubes. During pumping, liquid is forced up the annular space between the inner tube 33 and the outer tube 29 and then out the exhaust spout 31. Typically a hose extension is fastened to the spout. During pumping, air is drawn to the top of the shaft through the air passage and also down past the O-ring. The air then passes downwardly between the shaft and the inner tube.

Figure 3:
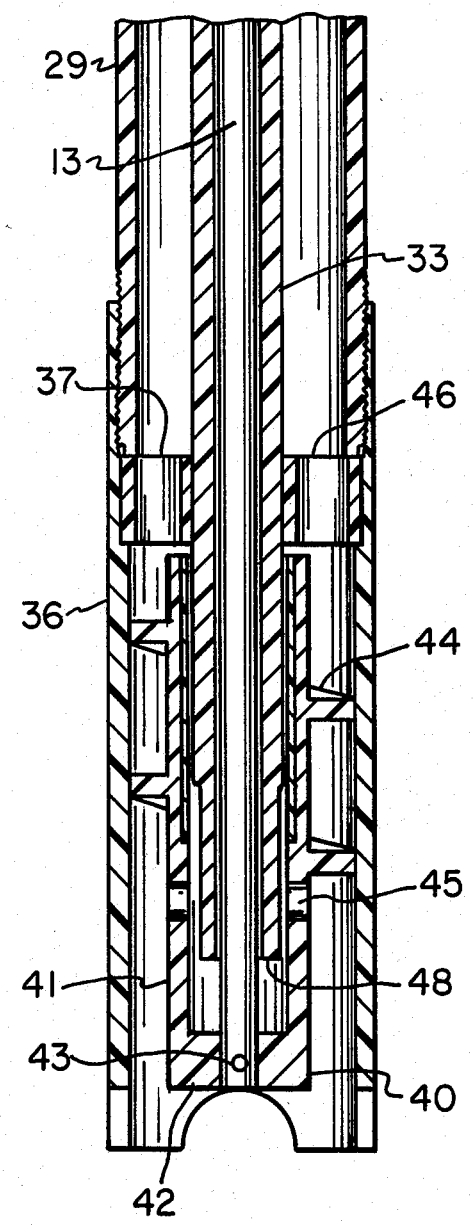
FIG. 3 illustrates in section the lower portion of a pump according to this invention.

Referring now to FIG. 3, the lower ends of the outer tube 29, inner tube 33, and shaft 13 are shown. The lower end of the outer tube has external threads enabling connection of the inlet tube 36 having internal threads. The lowermost end of the intake tube has a scalloped edge to insure liquid intake when the pump rests upon the bottom of a drum or the like.

A baffle spacer 37 positions the lower end of the inner tube 33 relative to the outer tube 29. The baffle spacer 37 is captured between the outer tube 29 and intake tube 36 preventing its axial movement.

Secured to the lower end of the driven shaft is a rotor 40. The rotor has a generally cylindrical sidewall 41 and an axial end face 42. The axial end face has an axial bore for snug receipt of the driven shaft 13 and a diametral bore therein for receiving a pin 43 to secure the rotor to the shaft. The upper external surface of the sidewall 41 has a helical flange 44 or screw secured thereto. Beneath the helical flange 44 are radial passages 45 in the sidewall. These passages must be spaced to be above the lower end 48 of the inner tube when the rotor 40 is in place.

The dimensions of the rotor, the driven shaft, the inner tube and other elements for a specific implementation according to this invention are set forth in Table 1.

TABLE 1

| | |
|---|---|
| Shaft Diameter | .250 + .000/−.002 |
| Inner Diameter of Inner Tube | .281 ± .005 |
| Outer Diameter of Inner Tube | .420 + .000/−.005 |
| Inner Diameter of Rotor | .500 ± .002 |
| Outer Diameter of Rotor (at passages) | .687 ± .002 |
| Outer Diameter of Helical Flange | 1.346 ± .001 |
| Inner Diameter of Outer Tube | 1.378 ± .005 |

The helical flange 44 according to this specific implementation has a one inch pitch and the axial length of the flange is approximately two inches. The axial length of the rotor 40 is 3½ to 4 inches long. The radial passages 45 are positioned (axially) just below the flange. The inner tube extends at least 2½ to 3 inches into the rotor so as to extend below the radial passages. The interior surface of the sidewall is slightly spaced from the exterior surface of the inner tube.

During operation, the rotation of the rotor 40 provides two actions. First, rotation results in a pressure drop across the radial passages 45 from inside to outside of the rotor resulting in a mixture of air and liquid being thrown out of the interior of the rotor. This action draws liquid down along the space between the inner tube 33 and the rotor 40. It also draws air down along the space between the shaft 13 and the inner tube 33. Studies with transparent models have shown that the space along the shaft becomes completely filled with down flowing air during rotation of the rotor. In other words, liquid is drawn down through the space between the inner tube and the rotor and is thrown out of the radial passages drawing air along the shaft with it.

The second action of the rotor is to lift fluid upward by the auger action of the rotating helical flange 44. This second action does the pumping that empties liquid from the drum or the like.

Figure 4:
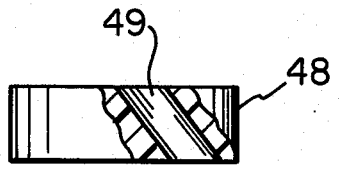
FIG. 4 is a broken away side view of the baffle according to this invention illustrating the angular position of one of the several passages.
Figure 5:
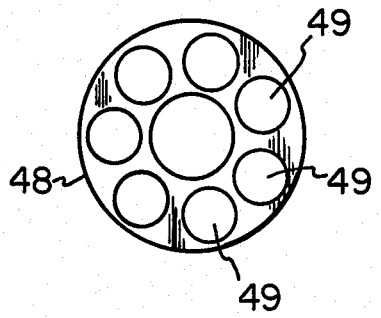
FIG. 5 is a top view of the baffle shown in FIG. 4.

Just above the rotor is located the baffle spacer 37. The baffle spacer has openings 46 therein that permit the fluid to be thrown upward by the helical flange. This baffle serves a critical function. It has been found that without the baffle or other means, liquid and entrained air is drawn down in the space between the rotor and the inner tube. In this way, the amount of air entrained in the volume just above the rotor increases until a cloud of air bubbles is established. This cloud of air bubbles can actually stop liquid from being advanced upwardly through the pump. However, the insertion of the baffle greatly reduces the cloud and dramatically increases the output of the pump. It has been found that the baffle 37 should be constructed to have passages that accommodate the swirling of the fluid lifted by the helical flight as well as the upward axial motion. Referring to FIGS. 4 and 5, a preferred embodiment of the baffle 48 is shown with passages 49 arranged to open on the upper side of the baffle at a position rotated from the intake opening on the lower side of the baffle. The rotation, of course, is in the direction of swirl caused by the rotor. Other means may be provided to prevent the recirculation of air down through the second clearance. For example, a widening of the outer tube just above the rotor will prevent the recirculation.

While we do not wish to be bound by a proposed theory, we believe that the impeller action of the rotor throwing a mixture of air and liquid radially outward increases the differential pressure through the inner tube beyond that which could otherwise be achieved. It should be noted that during pumping the entire length of the inner tube becomes filled with air downwardly flowing therethrough even when at first the drum is filled and the static head is its greatest. Thus there is difference in kind over the prior art illustrated in U.S. Pat. No. 4,073,606 wherein the air is drawn down but the static head is not overcome. The positive flow of air down and out of the bottom of the inner tube 33 provides a purging action that protects the bearings 21 and motor from corrosive vapor during the time when the O-ring seal 26 is ineffective to do so.

An important feature of the pump disclosed herein is that it is not sensitive to wear. For example, the clearance between the rotor 40 and the inner tube 33 for the specific embodiment described in Table 1 could be enlarged six-fold without losing the positive air flow down along the driven shaft. For the pump described herein, a six-fold increase in the space between the rotor and the inner tube is equivalent to pumping water carrying ten percent abrasives for approximately three years.

Another important feature of the invention is the location of the radial passages 45 in the rotor. The passages must be positioned to have a supply of liquid at the inner openings thereof. It is essential that liquid as well as air is thrown out through the passages. Thus, the passages are preferably just below the helical flange 44. If the passages are lowered or the lower end of the inner tube is raised so that the passages are not adjacent a portion of the outer cylindrical wall of the inner tube, the air purge fails. Again, the applicants do not wish to be bound by theories, but believe that the effectiveness of the impeller action of the rotor depends upon a supply of liquid as well as air to be thrown radially outward through the passages.

Although the gap between the rotor and the outer cylindrical surface of the inner tube is not critical, the annular space between the inner surface of the inner tube 33 and the driven shaft 13 is critical. With reference to the specific embodiment described with reference to Table 1, a fifty percent increase in the area of this annular space will overload the pump with air and render it ineffective. Since the liquid is drawn down out of the space during pumping carrying with it any possible abrasive ingredient that had worked therein, wear between the shaft 13 and the inner tube 33 is almost nonexistent. There is no radial force upon the shaft and hence there will be only random touching due to nonalignment.

The specific materials of construction used in the pumps according to this invention may vary. The outer tube or pipe has successfully been manufactured from $1\frac{5}{8}$ inch polypropylene tube, $1\frac{1}{2}$ inch 316 grade stainless steel tube, $1\frac{5}{8}$ inch Kynar (polyvinylidene flouride (PVDF)) tube, and $1\frac{1}{4}$ inch Hastelloy C tube. Hastelloy C is a well-known nickelmolybdenum-chromium-iron alloy that is excellent in resistance to many chemical solutions. The rotor, inner tube, and spacers are suitably fabricated from polytetrafluoroethylene (PTFE). The shaft is typically Hastelloy C or 316 grade stainless steel.

Having thus described our invention with the detail and particularity required by the Patent Laws, what is claimed and desired to be protected by Letters Patent is set forth in the following claims:

1. An axial flow liquid pump comprising:

an outer tube having an intake opening at one end for liquid to be pumped and an outlet opening near the opposite end;

an inner tube within the outer tube and means placing the interior of the inner tube in continuous communication with a supply of gas;

a driven shaft with one end journaled near the outlet end of the inner tube and the other end free;

a rotor having a sidewall, said rotor being secured on the free end of the shaft such that its sidewall is at least partially spaced between the inner tube and the outer tube;

said rotor having means to cause a pressure differential along the interior of the outer tube;

said rotor having at least one radial impeller passage in the sidewall, there being a first clearance between the inner surface of the inner tube and the shaft to permit a continuous flow of gas, there being a second clearance between the outer surface of the inner tube and the inner surface of the sidewall of the rotor, said radial impeller passages positioned such that gas and liquid are continuously drawn through the first and second clearances respectively and expelled through the passage.

2. An axial flow pump according to claim 1 wherein means to prevent gas recirculation through the second clearance comprises an annular plate with a plurality of spaced passages.

3. An axial flow pump according to claim 2 wherein the passages in the annular plate are canted.

4. The axial flow liquid pump according to claim 1 wherein the impeller passages open onto the first clearance.

5. An axial flow liquid pump comprising:

an outer tube having an intake opening at one end for being immersed in liquid to be pumped and an outlet opening near the opposite end;

a smaller diameter inner tube within the outer tube and means placing the interior of the inner tube in communication with ambient air;

a driven shaft with one end journaled near the outlet end of the inner tube and the other end free;

a cup-shaped rotor having a substantially cylindrical sidewall and an imperforate axial end face, said end face being secured on the free end of the shaft and such that the cylindrical sidewall is at least partially spaced between the inner tube and the outer tube;

said cup-shaped rotor having a helical flange secured to the outer surface of the cylindrical sidewall;

said rotor having radial impeller passages in the sidewall, there being a first clearance between the inner surface of the inner tube and the shaft to permit a continuous flow of air, there being a second clearance between the outer surface of the inner tube and the inner surface of the cylindrical sidewall of the rotor, said radial impeller passages positioned such that air and liquid are continuously drawn through the first and second clearances respectively and expelled through the passages; and means to prevent a substantial amount of air entrained in the fluid from recirculating through the second clearance such that the pumping ceases.

6. An axial flow pump according to claim 5 wherein said means to prevent recirculation comprises an annular plate with a plurality of spaced passages therethrough in which the passages are canted to accommodate the swirling action of the fluid.

7. The axial flow pump according to claim 6 wherein the annular plate is secured near the rotor to the outer tube.

8. Apparatus according to claim 5 wherein the inner tube and the rotor are manufactured from a fluorinated hydrocarbon polymer.

9. The axial flow liquid pump according to claim 5 wherein the impeller passages open onto the first clearance.

10. An axial flow liquid pump comprising:

a pendent outer tube having an intake opening at the lower end for being immersed in liquid to be pumped and outlet opening near the upper end;

a smaller diameter pendent inner tube substantially coaxial with the outer tube and means placing the interior of the inner tube in communication with ambient air;

a pendent driven shaft being journaled near the top of the inner tube or thereabove;

an upwardly opening cup-shaped rotor having a substantially cylindrical sidewall and an imperforate axial end face, said end face being secured in the lower end of the shaft and such that the cylindrical sidewall is at least partially spaced between the inner tube and the outer tube;

said cup-shaped rotor having a helical flange secured to the outer surface of the cylindrical sidewall;

said rotor having radial impeller passages in the sidewall below the helical flange, said impeller passages arranged to be above the lower end of the inner tube, there being a first clearance between the inner surface of the inner tube and the shaft to permit the continuous downward flow of air, there being a second clearance between the outer surface of the inner tube and the inner surface of the cylindrical sidewall of the rotor, such that air and liquid are drawn down in the first and second clearances respectively and expelled through the impeller passages below the helical flange; and a baffle plate having passages therein secured just above the rotor such that an insubstantial amount of air entrained in the fluid above the helical flange is recirculated through the second clearance.

11. An axial flow pump according to claim 10 wherein the baffle comprises an annular plate with a plurality of spaced passages therethrough in which the top opening of each passage is rotated around the axis of the driven shaft from the bottom opening of the passage in the normal direction of rotation of the driven shaft.

12. An axial flow pump according to claim 11 wherein the baffle comprises an annular plate having a plurality of spaced passages each passage having an axis which is generally in a plane parallel to the axis of the driven shaft and at an angle to a line in that plane which is parallel to the axis of the driven shaft.

13. The axial flow pump according to claim 10 wherein the baffle is secured just above the impeller to the outer tube.

14. Apparatus according to claim 10 wherein the inner tube and the rotor are manufactured from polytetrafluorethylene.

* * * * *